United States Patent [19]

Parks et al.

[11] 4,117,214

[45] Sep. 26, 1978

[54] METHOD AND COMPOSITION FOR REDUCING THE STRENGTH OF ICE

[75] Inventors: Christ F. Parks; Kenneth H. Nimerick, both of Tulsa, Okla.

[73] Assignee: The Dow Chemical Company, Midland, Mich.

[21] Appl. No.: 855,528

[22] Filed: Nov. 28, 1977

Related U.S. Application Data

[63] Continuation-in-part of Ser. No. 380,778, Jul. 19, 1973, abandoned.

[51] Int. Cl.[2] ..... C09K 3/18; C10K 5/00; F25C 1/00; F25C 1/12

[52] U.S. Cl. ..... 427/220; 44/1 R; 44/6; 62/1; 62/66; 106/13; 252/70; 427/421

[58] Field of Search ..... 44/6, 41, 1 R; 106/13; 252/70, 71, 78; 62/4, 66, 1; 427/220, 421

[56] References Cited

U.S. PATENT DOCUMENTS

| | | | |
|---|---|---|---|
| 2,101,472 | 12/1937 | Kormann | 106/13 |
| 2,116,682 | 5/1938 | Kleinicke | 44/6 |
| 2,222,370 | 11/1940 | Mori | 44/6 |
| 2,373,727 | 4/1945 | West | 106/13 |
| 2,436,146 | 2/1948 | Kleinicke | 44/6 |
| 2,454,886 | 11/1948 | Sapiro | 106/13 |
| 2,716,068 | 8/1955 | Fain | 106/13 |
| 2,973,254 | 2/1961 | Schmidt | 44/1 |
| 3,298,804 | 1/1967 | Schoch | 44/6 |
| 3,350,314 | 10/1967 | Dawtrey | 252/70 |
| 3,362,910 | 1/1968 | Ordelt | 252/75 |
| 3,624,243 | 11/1971 | Scott | 252/70 |
| 3,630,913 | 12/1971 | Scott | 252/70 |
| 3,794,472 | 2/1974 | Macaluso | 44/6 |

*Primary Examiner*—Dennis L. Albrecht
*Attorney, Agent, or Firm*—Glenn H. Korfhage

[57] ABSTRACT

The strength of ice is reduced by dissolving in water prior to freezing a composition of (A) a water-soluble polyhydroxy compound or monoalkylether thereof and (B) a water-soluble organic nonvolatile compound having a hydrophilic group such as amine, carboxyl or carboxylate groups in an amount to provide an effective amount, e.g., on the order of about 0.25–5 weight percent, of (A) plug (B) based on the weight of water. The method is especially useful for application to particulate solids, such as coal and mineral ores, which are shipped and stored in masses exposed to freezing temperatures. Any ice that is formed is physically weak and will not deter the unloading of the thusly conditioned particulate solids.

10 Claims, No Drawings

METHOD AND COMPOSITION FOR REDUCING THE STRENGTH OF ICE

CROSS-REFERENCE TO RELATED APPLICATION

This is a continuation-in-part of copending Ser. No. 380,778 filed July 19, 1973, now abandoned.

BACKGROUND OF THE INVENTION

There are many situations where excessive ice build-up is disadvantageous. One of the major difficulties is the force required to break up the ice. The prevention of ice formation as for example by lowering the freezing point is frequently impractical. However, if the strength of the ice was reduced, its break-up would be much easier making the accumulation less onerous.

When the surface moisture on particulate solids freezes the ice acts as a powerful adhesive holding the particles together in a mass. The adhesivity is influenced by both the particle size of the solids and the moisture content as shown later. For example, coal with as little as 4 percent moisture will, when frozen, cohere so strongly as to require special handling to break up the frozen mass. It thus becomes difficult to unload or dump railway cars, trucks and other conveyances used to transport coal, mineral ores and other finely divided solids. It also makes difficult the movement of coal out of outdoor coal storage piles in a condition for fuel or other use. Unloading frozen coal from railroad cars is time consuming, can result in blocked dump chutes and can often leave as much as 30 to 60 tons of coal in the car. Various techniques such as vibration, steam lances, fires under the cars, infrared heating in warming sheds and even dynamiting have been tried to unload frozen cars. The safety problems inherent in some of these techniques are obvious. Others are ineffective or totally impractical from an economic standpoint, particularly where conditions are so severe as to cause entire carloads of coal to freeze solid (as distinguished from merely perimeter freezing). All of these factors point to the definite need of developing an economic method of treating coal, ores and other divided solids to overcome the problems of transport of those solids.

Various approaches have been used with limited degrees of success. Sodium chloride and calcium chloride salts have been added to moist coal as it is being loaded with some degree of success toward reducing the freezing problem. However, such salts contribute to the corrosion of all equipment with which the solids come in contact and are detrimental to the coking process when used with coking coal. Oil has been used to freeze-proof coal with questionable effectiveness. Oil soluble surfactants have been added to the oil but with questionable results. Ethylene glycol has been employed, but although successful, the cost of treatment has been very high.

THE PRIOR ART

Schoch, U.S. Pat. No. 3,298,804 is directed to the prevention of freezing together of coal particles. That is accomplished with a composition of a hydrocarbon and a given class of surface-active compounds.

Kleinicke et al., U.S. Pat. No. 2,116,682 teaches treating coal with water containing a gel forming colloid and various inorganic salts. At page 3, right column, lines 5–23, the patent teaches some ice may form at low temperatures, but teaches away from suggesting the ice is modified by suggesting the solute becomes more concentrated in the remaining solution which is unfrozen. Kleinicke, U.S. Pat. No. 2,436,146, teaches addition of a protective agent such as a polyhydric alcohol to such a composition to prevent the salt from degrading the colloid.

Mori, U.S. Pat. No. 2,222,370 teaches a dust settling composition for coal mines which is an emulsion which may contain small quantities of ethylene glycol and oleic acid to give the emulsion greater permanence or stability, but no mention is made of cold weather applications.

Macaluso et al., U.S. Pat. No. 3,794,472, treat coal with an emulsion to prevent freezing of the coal.

Other art relating principally to deicing compositions or freeze depressants, particularly those suited for aircraft deicing applications, was cited in the parent application, including: Korman, U.S. Pat. No. 2,101,472, which teaches a gel containing gelatine to which is added as an antifreeze substance, glycerol and/or a glycol; West et al., U.S. Pat. No. 2,373,727, which teaches a composition such as in Korman, but also including a hydrocarbon to provide an emulsion; Fain et al., U.S. Pat. No. 2,716,068, which teaches a composition of a glycol, at least one of potassium thiocyanate, potassium acetate, urea, or certain inorganic salts, and optionally sodium nitrite; and Dawtrey et al., U.S. Pat. No. 3,350,314, which teaches a foamable composition of water, an alkylene polyol, and a long chain aliphatic tertiary amine.

Ordelt et al., U.S. Pat. No. 3,362,910, teaches an automotive antifreeze composition.

Scott, Jr., et al., U.S. Pat. Nos. 3,624,243 and 3,630,913, each relate to chemical deicers containing corrosion inhibitors making them specially suited for use on airport runways.

Finally, Shapiro, U.S. Pat. No. 2,454,886 relates to the prevention of mist and frost on glass and similar sheet material.

The foregoing art is generally directed to preventing the formation of ice or melting ice by modifying the freezing point of the water.

None of the art suggests allowing the ice to form but modifying the crystalline structure of the ice so that its physical strengths are reduced.

SUMMARY OF THE INVENTION

The present invention is directed to a method for treating water such that when frozen the resulting mass is physically weak and is not difficult to break apart. The invention is especially adapted to the treatment of moist particulate solids such that when the moisture is frozen the mass is easily broken apart. This is done by spraying the particles with a composition of (A) a water-soluble polyhydroxy compound or monoalkylether thereof and (B) a water-soluble organic nonvolatile compound in an effective amount, (A) being a different compound from (B) in a particular formulation.

By "water-soluble" is meant sufficiently soluble so that a sufficient quantity of said compound may be dissolved in water to noticeably affect the strength of ice formed from the water, when employed with the other component(s) according to the invention. Obviously, compounds should not be employed herein in quantities which exceed their mutual solubilities in water.

The invention is useful with water itself and with all forms of divided moist solids which themselves are neither water-soluble nor water swellable. Typical of such materials are coal and mineral ores such as iron and copper ore. Such solids are usually stored in piles exposed to the atmosphere and transported in railroad cars or trucks open to the environment. They thus are exposed to the rain and the other elements where they collect significant amounts of surface moisture. When the temperature drops below freezing, the particles are bound together by the ice formed at the surfaces and require mechanical and thermal means to break up the mass before loading or unloading operations.

One of the ingredients useful in the compositions employed in the present method is a water-soluble polyhydroxy compound. A preferred group is the polyhydroxyalkanes. Typical members of that class are ethylene glycol, di-ethylene glycol, triethylene glycol, propylene glycol, di-propylene glycol, glycerine and sugar. Of those materials, ethylene glycol is preferred. The monoalkyl ethers, such as the monobutyl ether of ethylene glycol, are also useful. Mixtures of alkylene glycols may also be employed as Component A, for example, a mixture such as ethylene glycol and 1,2-propylene glycol.

The second material to be used in the treating of the finely divided particles is a water-soluble organic nonvolatile compound. The compound must be nonvolatile, i.e., have a sufficiently low vapor pressure at the conditions of use, so that substantially none of the compound will vaporize out of the aqueous solution before the water freezes. This compound should have at least one hydrophilic group such as amine, carboxyl, or carboxylate groups. The compound may be polymeric or nonpolymeric. Typical of the latter are fumaric acid, urea, glycolic acid, tetrasodium salt of ethylene diamine tetraacetic acid, sodium acetate and acetic acid. Other amines and carboxylic materials will be known to the skilled worker. Typical of the polymeric materials are polyacrylamide, polyvinyl pyrrolidone, polyethyleneimine, polyacrylates, polyamide copolymers such as that sold commercially as Arco S-232, and the natural gums, such as guar gum. All of the useful polymers will be of relatively low molecular weight in order to be water-soluble. Judicious selection of other useful polymers can be made by reference to standard references with an optimum choice determined by simple preliminary experiment.

The amount of the material incorporated in the water and the ratio of the hydroxy compound with the organic non-volatile compound may be varied within wide limits. The amount used should be that minimum needed to lower the strength of the frozen mass such that it can be easily broken. The actual amount will depend in large measure on the particle size, the amount of moisture, the condition of exposure of the particles and to some extent on the choice of materials. As a general rule, a concentration of about 0.5 weight percent of combined materials based on the moisture will suffice to achieve the objectives of the invention, although lesser amounts may also suffice in some instances as indicated by laboratory tests wherein using about 0.25 percent additive by weight of total moisture, the compressive strength of a mass of 1 inch ×0 coal was reduced by one third. In very severe exposure conditions somewhat more may be desired, although when compared to methods dependent on maintaining the water as a liquid, the amount of solute employed herein is relatively independent of the temperature to be encountered. Thus, once treated a mass of particulate is adequately protected even against an unexpectedly severe drop in temperature. The upper limit is determined principally by economic factors.

The ratio of the hydroxy compound to organic nonvolatile compound will depend on a number of factors including those listed above for the amount of material to be used. Also some of the polymeric substances cause a large increase in viscosity which is troublesome to apply to the particles. As a general rule the combination of ingredients will contain about 0.001 to about 2 parts of the organic nonvolatile compound for each part of polyhydroxy compound. Optimum selection will be readily made with simple routine experiments.

The compositions used in the treatment may also include other materials such as dyes and colorants to indicate the progress of the treatment, stabilizers and anti-oxidants and other conventionally added materials. In all cases, such additive must be water-soluble.

The compositions of this invention may be admixed with moist particulates using conventional techniques. One convenient method is to locate a spray bar above the discharge end of a loading conveyer and another spray bar below. As the particles tumble off the conveyor the possibility that moisture present on the particles will come into intimate contact with the spray applied composition is improved.

The invention will be illustrated with the following examples wherein all parts and percentages are by weight unless otherwise indicated:

EXAMPLE 1

Ice samples were prepared by first dissolving the desired chemicals into water. The water solution was chilled to about 40° F. before pouring into brass molds.

The brass molds were 2 inches × 2 inches × 2 inches. The molds were sprayed with a mold release agent and placed in a 0° F. freezer for several hours prior to pouring the chilled water solution into the molds. The ice remained in the molds for at least 16 hours at 0° F. before being removed for testing.

The compressive strength of these 2 inch × 2 inch × 2 inch ice cubes was determined using a Tinius Olsen hydraulic press. The steel jaws of the press were precooled by placing ice between the faces and maintaining a pressure on the ice while it was melting. The cooling time was about five minutes. The ice cubes were then inserted between the steel plates and the plates closed by hydraulic pressure at a rate of 1.7 centimeters per minute. The pressure at which the ice broke was recorded.

The results are shown in Table I.

TABLE I

| Agent | Compressive Strength (psi) |
|---|---|
| — | 364* |
| 0.1% polyacrylamide M.W. 6M (30% hydrolyzed) (A) | 287 |
| 0.2% " | 220 |
| 0.5% " | 170 |
| 1.0% " | 148 |
| 0.1% polyacrylamide (25% hydrolyzed) lightly crosslinked with methylene bis acrylamide | 312 |
| 0.2% " | 220 |
| 0.5% " | 280 |
| 1.0% " | 185 |
| 0.05% ethylene glycol (EG) | 358 |
| 0.1% " | 245 |
| 0.25% " | 225 |
| 0.5% " | 265 |

TABLE I-continued

| Agent | Compressive Strength (psi) |
|---|---|
| 1.0% " | 195 |
| 2.5% " | 95 |
| 5.0% " | 50 |
| 0.05% EG + 0.1 (A) | 280 |
| 0.1% " | 198 |
| 0.25% " | 120 |
| 0.5% " | 95 |
| 1.0% " | 97 |
| 2.5% " | 60 |
| 5.0% " | 30 |

*Average of 5 tests

The same trend in the reduction of strength of the ice was shown when the rate of jaw closure was increased to 4 centimeters per minute.

EXAMPLE 2

Numerous materials were used to demonstrate their effectiveness in reducing the strength of ice. The samples were prepared and tested according to the procedures of Example 1. The results are shown in Table II.

TABLE II

| Agent % | Compressive Strength (psi) |
|---|---|
| — | 384 |
| 2.5 Ethylene glycol (EG) | 145 |
| 0.5 Polyvinyl pyrrolidone (M.W. 360,000) | 665 |
| 0.5 Polyvinyl pyrrolidone (M.W. 360,000) + 2.5 EG | 130 |
| 0.5 Guar gum | 1050 |
| 0.5 Guar gum + 2.5 EG | 82 |
| 0.5 Polyacrylate-polyamide copolymer (Arco S-232) | 360 |
| 0.5 Polyacrylate-polyamide copolymer (Arco S-232) + 2.5 EG | 115 |
| 0.5 Polyacrylamide 6M̄ M.W. 30% hydrolysis | 445 |
| 0.5 Polyacrylamide 6M̄ M.W. 30% hydrolysis + 2.5 EG | 67 |
| 0.5 Polyacrylamide-cationic form | 232 |
| 0.5 Polyacrylamide-cationic form + 2.5 EG | 45 |
| 0.5 Sodium polyacrylate | 372 |
| 0.5 Sodium polyacrylate + 2.5 EG | 115 |
| 0.5 Gelatin | 525 |
| 0.5 Gelatin + 2.5 EG | 52 |
| 0.5 (75% polyacrylamide-25% gelatin) + 2.5 EG | 93 |
| 0.5 (50% polyacrylamide-50% gelatin) + 2.5 EG | 93 |
| 0.5 (25% polyacrylamide-50% gelatin) + 2.5 EG | 50 |
| 0.5 Polyacrylamide-nonionic | 610 |
| 0.5 Polyacrylamide-nonionic + 2.5 EG | 65 |
| 2.5 Urea | 750 |
| 2.5 Urea + 2.5 EG | 100 |
| 2.5 Glycolic acid | 345 |
| 2.5 Glycolic acid + 2.5 EG | 62 |
| 2.5 Tetrasodium salt of ethylene diamine tetraacetic acid | 297 |
| 2.5 Tetrasodium salt of ethylene diamine tetraacetic acid + 2.5 EG | 82 |
| 2.5 Sodium acetate | 220 |
| 2.5 Sodium acetate + 2.5 EG | 90 |
| 0.1 Acetic acid | 492 |
| 0.1 EG | 265 |
| 0.1 Acetic acid + 0.1 EG | 115 |
| 0.5 Acetic acid | 325 |
| 0.5 EG | 265 |
| 0.5 Acetic acid + 0.5 EG | 102 |
| 2.5 Acetic acid | 267 |
| 2.5 EG | 95 |
| 2.5 Acetic acid + 2.5 EG | 50 |
| 2.5 Ethylene glycol monobutyl ether | 317 |
| 2.5 Ethylene glycol monobutyl ether + 0.5 polyacrylamide M.W. 6M̄ (30% hydrolysis) | 190 |
| 2.5 Diethylene glycol | 97 |
| 2.5 Diethylene glycol + 0.5% polyacrylamide M.W. 6M̄ (30% hydrolysis) | 57 |
| 2.5 Sugar | 302 |
| 2.5 Sugar + 0.5% polyacrylamide M.W. 6M̄ (30% hydrolysis) | 175 |
| 2.5 Sodium lignate | 537 |
| 2.5 Sodium lignate + 0.5 polyacrylamide M.W. 6M̄ (30% hydrolysis) | 490 |
| 2.5 Triethylene glycol | 215 |
| 2.5 Triethylene glycol + 0.5 polyacrylamide M.W. 6M̄ (30% hydrolysis) | 80 |

EXAMPLE 3

The effect of particle size and moisture content on the compressive strength of frozen particulate masses of coal was demonstrated. The coals employed included for one series of tests a filter cake coal of 28 mesh, a second series with a bulk coal passing 3 mesh (⅜ inch), and a third series with a blend of 90 parts of the bulk coal and 10 parts of the filter cake coal. The moisture content was adjusted by drying or the addition of water.

One hundred gram samples of the coal was added to a 2 inch internal diameter by 3.5 inch long polymethyl methacrylate cylinder. The walls of the cylinder were sprayed with a mold release agent prior to adding the coal. A metal lid was placed over the filled cylinder which was vigorously vibrated for 3 minutes. The top of the cylinder was covered with saran film and the so sealed cylinders placed in a freezer at 0° F. for at least 16 hours. The cylinders were removed from the freezer and the coal pushed out with a rubber stopper and returned to the freezer.

The compressive strength of the frozen coal was determined using a Tinius Olsen hydraulic press. The frozen coal with metal cup was placed between the steel jaws of the press which were closed at a rate of 0.6 centimeter per minute. The results are shown in Table III.

TABLE III

| Type Coal | Per Cent Moisture | Compressive Strength |
|---|---|---|
| Filter cake (28 mesh) | 20.0 | 67 |
| | 17.5 | 30 |
| | 13.1 | 5.4 |
| | 9.5 | 0.45 |
| | 7.0 | <0.45 |
| Bulk <3 mesh | 10.8 | 111.8 |
| | 9.7 | 46.4 |
| | 8.6 | 44.0 |
| | 7.5 | 42.7 |
| | 6.5 | 24.1 |
| | 5.4 | 7.3 |
| | 3.2 | <1.0 |
| 90 parts <3 mesh bulk 10 parts filter cake | 11.5 | 70.0 |
| | 10.0 | 62.0 |
| | 8.7 | 42.0 |
| | 7.4 | 17.0 |
| | 6.5 | 4.0 |
| | 6.0 | 1.0 |
| | 5.0 | <1.0 |

EXAMPLE 4

Coal was treated with various agents. The coals employed were the same as those used in Example 3 with the moisture content adjusted to a given value for each series.

The agents were applied by first blending the liquid agent with the coal followed by dry blending the dry agent until the agents were uniformly distributed.

The test specimens were prepared and tested as in Example 3. The results are shown in Table IV.

TABLE IV

| Series | Treatment per Ton of Coal | Compacted Height (cm) | Compressive Strength psi |
|---|---|---|---|
| 90 parts bulk 10 parts filter cake (7.48% moisture) | — | 6.0 | 16 |
| | 2 lbs (a)* | 6.0 | 15 |
| | 2 lbs (a) + 0.5 gal EG | 6.0 | 0.3 |
| | 2 lbs (a) + 1 gal EG | 6.0 | 0.64 |
| Bulk Coal (14.4% moisture) | — | 5.5 | 164.9 |
| | 2 lbs (a) | 6.2 | 80.9 |
| | 2 lbs (a) + 0.25 gal EG | 6.1 | 39.2 |
| | 2 lbs (a) + 0.5 gal EG | 6.3 | 22.3 |
| | 2 lbs (a) + 1 gal EG | 6.1 | 14.6 |
| | 4 lbs (a) + 0.25 gal EG | 6.7 | 18.5 |
| | 4 lbs (a) + 0.5 gal EG | 6.1 | 15.9 |
| 90 parts bulk 10 parts filter cake (10% moisture) | — | 5.9 | 44.3 |
| | 2 lbs (a)* | 5.8 | 37.3 |
| | 2 lbs (a) + 0.125 gal EG** | 5.8 | 27.0 |
| | 2 lbs (a) + 0.25 gal EG | 5.7 | 14.3 |
| | 2 lbs (a) + 0.5 gal EG | 5.9 | 6.7 |
| | 2 lbs (a) + 1 gal EG | 6.1 | 6.0 |
| | 0.125 gal EG | 5.9 | 36.3 |
| | 0.25 gal EG | 6.0 | 22.3 |
| | 0.5 gal EG | 6.0 | 16.2 |
| | 1.0 gal EG | 6.1 | 10.8 |

*(a) = a blend of 90% bentonite clay and 10% polyacrylamide M.W. = 6M
**EG = ethylene glycol

EXAMPLE 5

The effect of other combinations of agents was determined using the blend of 90 parts bulk coal and 10 parts filter cake coal used in Examples 3 and 4 with the moisture adjusted to 10.9% for one series and 6.7% for another series. The agents were added and the test specimens prepared and tested as in the previous examples. The results are shown in Table V.

TABLE V

| Agent, gallons or pounds per ton | Height of Coal After Vibration (cms) | Compressive Strength (psi) |
|---|---|---|
| Series A - 10.9% moisture | | |
| — | 5.5 | 83.4 |
| 0.09 gal 95% EG + 5% by volume glacial acetic acid (GAA) | 6.1 | 21.6 |
| 1.0# EG + 0.05# GAA | 5.7 | 44.6 |
| 2.0# EG + 0.10# GAA | 5.7 | 27.0 |
| 4.0# EG + 0.20# GAA | 6.1 | 9.8 |
| Series B - 6.7% moisture | | |
| — | 5.7 | 6.7 |
| — | 6.1 | 6.1 |
| 0.09 gal 95% EG + 5% GAA by volume | 6.6 | 6.0 |
| 0.09 gal 95% EG + 5% GAA by volume | 6.1 | 6.7 |
| 0.125 gal 95% EG + 5% GAA by volume | 6.4 | 1.3 |

EXAMPLE 6

Additional tests using a mixture of ethylene glycol and 1,2-propylene glycol as Component (A) were carried out as in Examples 1 and 2, except that a Baldwin hydraulic press was employed at a jaw closure rate of 7.8 cm/min. Results were as follows:

| Agent, % | Compressive Strength, psi |
|---|---|
| Water only | 348 |
| 1.25% propylene glycol + 1.25% ethylene glycol | 124 |
| 2.5% sodium acetate | 115.5 |
| 2.5% a blend of 47.5% ethylene glycol, 47.5% propylene glycol, and 5% sodium acetate | 95 |

The foregoing blend of glycols and sodium acetate may be safely employed with routine precautions and safety equipment, making it attractive for use even by individuals with little training. The blend has been accepted for use in underground mines by the Mining Enforcement and Safety Administration of the U.S. Department of the Interior. Moreover, it is substantially non-corrosive, does not significantly affect coal processing steps, e.g., froth flotation, and does not leave quantities of residues detrimental to blast furnace or coking operations.

EXAMPLE 7

It is well documented that notwithstanding the availability of the teachings of the prior art, coal freezing in railroad cars was a severe problem in the Northeastern part of the United States during the particularly severe cold weather experienced during January and February, 1977. See *Business Week,* pages 32–34, Feb. 14, 1977. However, in contrast to untreated cars some of which simply could not be unloaded using any of the conventional heating and vibration techniques, cars treated with effective amounts of the above mentioned blend consisting of 47.5% ethylene glycol, 47.5% propylene glycol, and 5% sodium acetate, emptied easily. Details of some of these field observations and the rapid commercial success realized by the above mentioned blend are set forth in Affidavits filed in the parent application, copies of which will be available in the present file wrapper and the statements of which are expressly incorporated herein.

What is claimed is:

1. A method for reducing the strength of ice wherein
(1) an effective amount of a strength reducing composition is dissolved in the water prior to freezing, said composition consisting essentially of water soluble components comprising (A) a water soluble polyhydroxy compound selected from the group consisting of alkylene glycols and (B) from about 0.001 to about 2 parts sodium acetate per part of polyhydroxy compound, said composition being substantially free of corrosion inducing metal halide salts, and
(2) the so formed solution is thereafter exposed to a temperature sufficiently low to freeze the so formed solution.

2. The method of claim 1 wherein components (A) and (B) are employed in a combined amount of at least about 0.5 percent by weight of water.

3. A method for reducing the strength of ice wherein
(1) an effective amount of a strength reducing composition is dissolved in the water prior to freezing, said composition consisting essentially of water soluble components comprising (A) a water soluble polyhydroxy compound selected from the group consisting of alkylene glycols and (B) polyacrylamide having at least 10 percent hydrolysis, in an amount of from about 0.001 to about 2 parts partially hydrolyzed polyacrylamide per part of polyhydroxy compound, said composition being substantially free of corrosion inducing metal halide salts, and (2) the so formed solution is thereafter exposed to a temperature sufficiently low to freeze the so formed solution.

4. The method of claim 3 wherein components (A) and (B) are employed in a combined amount of at least about 0.5 percent by weight of water.

5. A method for treating particulate solids having surface moisture to reduce the cohesive strength of masses of such solids when frozen, said particulate solids being neither water soluble nor water swellable, said method consisting of spraying such solids with an effective amount of a fluid composition consisting essentially of water soluble components comprising (A) a water soluble polyhydroxy compound selected from the group consisting of alkylene glycols and (B) from about 0.001 to about 2 parts sodium acetate per part of polyhydroxy compound, said composition being substantially free of corrosion inducing metal halide salts.

6. The method claimed in claim 5 wherein said composition is applied to said solids in an amount of at least 0.5 weight percent of (A) plus (B) based on the surface moisture on the solids.

7. The method claimed in claim 5 wherein said particulate solids are coal having a particle size of less than about 2 inches.

8. A method for treating particulate solids having surface moisture to reduce the cohesive strength of masses of such solids when frozen, said particulate solids being neither water soluble nor water swellable, said method consisting of spraying such solids with an effective amount of a fluid composition consisting essentially of water soluble components comprising (A) a water soluble polyhydroxy compound or monoalkyl ether thereof and (B) polyacrylamide having at least 10 percent hydrolysis, in an amount of from about 0.001 to about 2 parts partially hydrolyzed polyacrylamide per part of component (A), said compound (B) being different from said compound (A), and said composition being substantially free of corrosion-inducing metal halide salts.

9. The method claimed in claim 8 wherein said composition is applied to said solid in an amount of at least 0.5 weight percent of (A) plus (B) based on the surface moisture on the solids.

10. The method claimed in claim 8 wherein said particulate solids are coal having a particle size of less than about 2 inches.

* * * * *